US007305994B2

(12) United States Patent
Dall'Osso et al.

(10) Patent No.: US 7,305,994 B2
(45) Date of Patent: Dec. 11, 2007

(54) DEVICE AND A METHOD FOR SEPARATING AT LEAST ONE CONTINUOUS ROD OF FORMING MATERIAL FOR TOBACCO PRODUCTS

(75) Inventors: Davide Dall'Osso, Bologna (IT); Massimo Sartoni, Bologna (IT); Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 568 days.

(21) Appl. No.: 10/773,140

(22) Filed: Feb. 9, 2004

(65) Prior Publication Data

US 2004/0163657 A1 Aug. 26, 2004

(30) Foreign Application Priority Data

Feb. 20, 2003 (IT) ..... BO2003A0080

(51) Int. Cl.
*A24C 5/18* (2006.01)

(52) U.S. Cl. ..... 131/84.1; 131/27.1; 131/57; 131/60; 131/77

(58) Field of Classification Search ..... 131/281, 131/96, 58, 60, 77, 84.1, 27.1; 225/97, 93, 225/98, 103, 104, 105
See application file for complete search history.

(56) References Cited

U.S. PATENT DOCUMENTS 2,875,689 A * 3/1959 Wright ..... 101/227
3,567,010 A * 3/1971 Vom Stein ..... 198/790
4,226,352 A 10/1980 Watson
4,461,415 A 7/1984 Seragnoli
4,651,757 A * 3/1987 Ohyatsu et al. ..... 131/96
4,852,588 A * 8/1989 Piana et al. ..... 131/84.1

FOREIGN PATENT DOCUMENTS

EP 1300088 4/2003

OTHER PUBLICATIONS

European Search Report dated Jun. 24, 2004.

* cited by examiner

*Primary Examiner*—Eric Hug
*Assistant Examiner*—John B. Edel
(74) *Attorney, Agent, or Firm*—Timothy J. Klima

(57) ABSTRACT

A continuous tobacco rod generated by a machine for making tobacco products is separated into reclaimable lengths by a device that comprises a pair of tension rollers designed to exert a pulling force on the rod, also a pair of brake rollers operating upstream of the tension rollers and serving to offer a measure of resistance to the action of the tension rollers; as a result of the interaction between the tension rollers and the brake rollers, the portion of the continuous rod extending between them is forced to break by tearing apart.

23 Claims, 3 Drawing Sheets

DEVICE AND A METHOD FOR SEPARATING AT LEAST ONE CONTINUOUS ROD OF FORMING MATERIAL FOR TOBACCO PRODUCTS

BACKGROUND OF THE INVENTION

The present invention relates to a device for separating at least one rod of forming material as used in manufacturing tobacco products, applicable in particular to a machine by which such products are made and reflecting the prior art as recited in claim 1.

The invention relates also to a method by which at least one continuous rod of forming material for tobacco products is separated into a plurality of reclaimable lengths, implementing steps reflecting the prior art as recited in claim 22.

The invention finds application particularly in the field of manufacturing tobacco products, namely cigarettes, cigars and the like, where use is made of machines equipped with a unit serving to fashion a forming material into at least one continuous rod, or tobacco rod, and a cutter device by which the newly formed continuous rod is divided into a succession of discrete portions each destined to become a respective tobacco product.

In conventional machines used for making tobacco products, such as those described and illustrated in patents IT 1208281 and IT 1171577 and in Italian patent application BO02001A 000604, certain parts of the continuous rod of forming material have to be discarded due to their presenting characteristics incompatible with the manufacture of a marketable tobacco product. The parts destined typically to be discarded will include the initial endmost portion of a continuous rod being formed by the machine, and any intermediate parts happening to display characteristics similar to the end portion.

Defective parts are eliminated normally by means of a separation or rod breaker device operating between the forming unit and the aforementioned cutter device.

The separation device, as disclosed in Italian patent IT 1208281, consists generally in a strimmer style cutter, that is to say a rotating head with slender radial or diametral members, driven at high speed by a motor, which is positioned to intercept the advancing continuous rod and divide it up into successive pieces of predetermined length.

Ordinarily, the separation device operates in conjunction with a cut-off device installed in such machines between the unit forming the continuous rod, and the cutter device. The cut-off device is designed typically to divide the continuous rod into two portions: the first, advancing toward the cutter device downstream of the cut-off device, and the second fed through the machine upstream of the cut-off device.

The cut-off device is also able to redirect the advancing continuous rod from its original path by directing it toward the separation device. More exactly, this redirection of the continuous rod can be brought about by a diverter element associated with the cut-off device and presenting a curved profile that extends transversely to the direction followed by the continuous rod.

To effect the change of direction, accordingly, the cut-off device must be shifted in such a way that the diverter element is positioned along the path followed by the advancing continuous rod. As it advances, the continuous rod being formed by the machine will encounter the diverter element and as a result, veer transversely from the original feed path.

As illustrated in application BO2001A 000604, the continuous rod advanced by the machine is deflected by a diverter element that forms an integral part of the cut-off device. In other words, the cut-off device presents a sharp pointed portion positioned to slice through the advancing continuous rod, and a substantially arcuate portion extending from the sharp portion, functioning as the diverter element, which serves to deflect the continuous rod directly toward a bin serving to collect reject material, or a reclaiming station. Likewise in this situation, the redirection of the continuous rod is brought about by positioning the cut-off device in such a way as will enable the diverter element or arcuate portion to intercept the continuous rod.

Once the cutting action has been produced by the sharp point of the cut-off device, a portion of the continuous rod not suitable for making into tobacco products will be carried toward the cutter device of the machine, where the unwanted forming material is broken up into a succession of small fragments that fall by gravity directly into a reclaiming station located beneath the cutting area.

Whilst it is true that devices used to separate continuous rods of forming material for tobacco products are able, as also are the machines used in making such products, to recover a fair quantity of forming material momentarily unsuitable for making into saleable tobacco products, they nonetheless present certain drawbacks and might be improved in a number of ways, with regard mainly to the quality of the forming material collected and reutilized subsequently in the process of fashioning further continuous rods, and as regards the amount of the forming material collected and the reduction in production costs achievable by reclaiming material that would normally be discarded.

More particularly, the applicant finds that the effect of dividing up continuous rods of forming material into portions employing cutter devices of whatever description (reciprocating and/or rotary), for example those with a rotating head and other such separation devices, is to break up the forming material to a degree that the value of recovering and/or reutilizing it becomes questionable.

More exactly, when reject portions of continuous rods are subjected to these cutting operations, the tobacco fibers which make up the greater part of the forming material are significantly degraded, in that by being notably shortened, their dimensions will be reduced to the point of disallowing further use.

Conversely, if the reclaimable continuous rod is not broken up, a laborious unpicking operation is required in order to recover the tobacco fibers contained in the filler, which in turn will signify a considerable expenditure of time and resources tending to impact on overall production costs and, ultimately, on the costs of marketing and selling the product.

The object of the invention is to overcome the problems identifiable in the prior art by providing a device for separating at least one continuous rod of forming material for tobacco products, and a method by which to divide the separated rod into a plurality of discrete lengths, such as will also preserve the original properties of the forming material.

Another object of the invention is to achieve a significant reduction in production costs through the recovery of rejected forming material.

SUMMARY OF THE INVENTION

The stated objects are realized according to the present invention in a device for separating at least one continuous rod of forming material for the manufacture of tobacco products, applicable to a machine for making tobacco products affording a feed path along which the continuous rod is caused to advance, and equipped with at least one cut-off device by which the continuous rod is severed and diverted from the feed path, the function of the separation device being to engage the diverted continuous rod of forming material and divide it into a plurality of discrete lengths.

The device comprises a gripping unit designed to act on the diverted continuous rod by applying forces oriented substantially parallel to the longitudinal dimension of the rod and from opposing directions, so as to generate a tensile stress in the diverted rod that will cause it to break by tearing apart.

The stated objects are realized similarly in a method according to the invention for separating at least one continuous rod of forming material for tobacco products into a plurality of reclaimable lengths, wherein the separation of the continuous rod involves the step of applying at least two forces oriented parallel to the longitudinal axis of the diverted continuous rod and from opposing directions.

To advantage, the step of separating the diverted continuous rod into discrete reclaimable lengths is implemented without the use of any cutting action.

BRIEF DESCRIPTION OF THE DRAWINGS

The invention will now be described in detail, by way of example, with the aid of the accompanying drawings, in which.

DESCRIPTION OF THE PREFERRED EMBODIMENTS

With reference to the drawings, 1 denotes a device according to the invention, in its entirety, serving to separate at least one continuous rod of forming material for making tobacco products.

Figure 1:
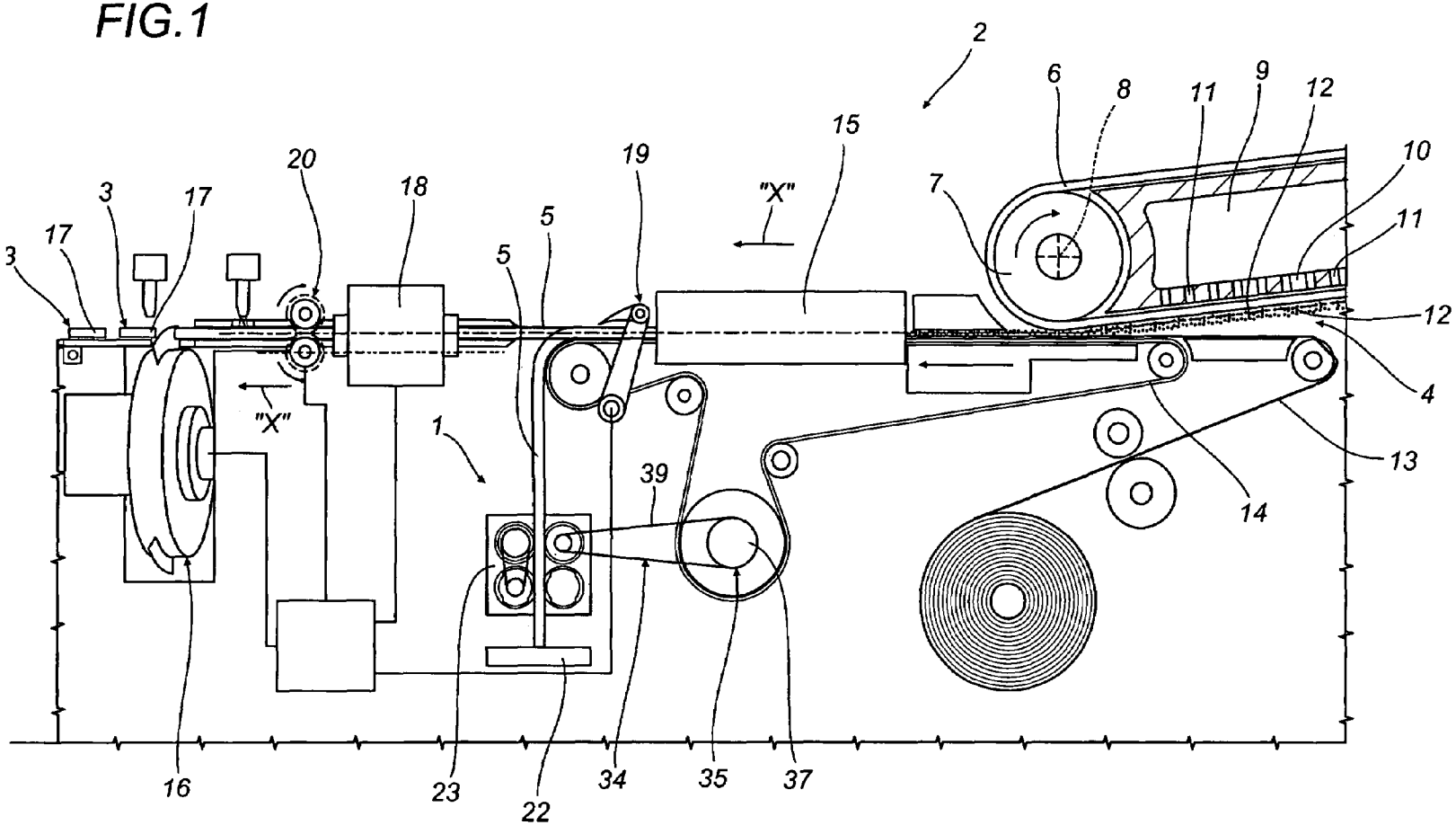
FIG. 1 is a fragmentary schematic side elevation illustrating a machine for making tobacco products, equipped with a device for separating a continuous rod of forming material, embodied in accordance with the present invention.

As discernible from FIG. 1, the separation device 1 is associated with a machine 2 for making tobacco products 3, typically cigarettes, cigars and the like. More exactly, the machine 2 comprises a forming unit 4 serving to generate at least one continuous rod 5 of forming material from which to fashion the aforementioned tobacco products 3. The forming unit 4 comprises a conveyor belt 6 looped around pulleys 7 (one only of which is illustrated in FIG. 1) rotatable about respective horizontal and mutually parallel axes 8.

The closed loop described by the conveyor belt 6 encompasses a chamber 9 connected to a source of negative pressure (not illustrated) and delimited at the bottom by a wall 10 presenting a plurality of suction holes 11. As illustrated in FIG. 1, the bottom branch of the looped conveyor belt 6 is breasted in sliding contact with the aforementioned wall 10. The conveyor belt 6 is able, through the force of suction, to attract and retain particles or fibers of tobacco 12 emerging from a vertical riser duct (not illustrated) positioned below the bottom branch and destined to make up the greater part of the aforementioned forming material, in such a way that the core of the continuous rod 5 can be pre-shaped as the stream of particles is advanced on the belt.

As illustrated in FIG. 1, the continuous stream of tobacco is directed constantly by the bottom branch of the conveyor belt 6 along a substantially horizontal feed path extending transversely to the axes 8 of rotation of the pulleys 7.

Also directed through the forming unit 4 is a strip 13 of paper material coming from a relative feed station of the machine 2. In particular, the strip 13 is routed in such a manner as to advance in a substantially horizontal plane beneath the conveyor belt 6, its position maintained by suction generated through a transport belt 14 operating beneath the conveyor belt 6 and constituting part of the forming unit 4.

Still referring to FIG. 1, the paper strip 13 is interposed between the conveyor belt 6 and the transport belt 14 and facing directly toward the stream of tobacco. The strip 13 is carried by the transport belt 14 along the aforementioned feed path, denoted X, positioned to receive the tobacco from the bottom branch of the conveyor belt 6.

The forming unit 4 also comprises a beam 15 (of conventional embodiment) positioned along the feed path X downstream of the conveyor belt 6, by which the strip 13 is wrapped around the tobacco to form a continuous rod 5. More precisely, the beam 15 affords a passage along which the longitudinal edges of the strip 13 are overlapped and glued together. Thus, the continuous rod 5 emerging from the beam 15 appears as a core of tobacco filler enveloped in a cylindrical skin of paper.

Beyond the forming beam 15 and along the feed path X, in the downstream direction, the continuous rod 5 encounters a cutter device 16 constituting part of the machine 2, by which it is intercepted intermittently and divided into a succession of portions 17 each destined to become a cigarette.

The machine 2 further comprises a checker unit 18 interacting with the continuous rod 5 as it leaves the forming beam 15, and serving to verify that the rod is being correctly formed and/or to detect any defects.

Also installed on the feed path X, placed between the forming beam 15 and the checker unit 18, is a cut-off device 19 capable of movement between a position of disengagement, in which the continuous rod 5 emerging from the beam 15 is free to advance as normal along the feed path X, and a position of interference in which the rod 5 is cut through and diverted from the feed path by the device 19. The cut-off device 19 can come into operation during the start and/or stop cycle of the machine 2, or in response to a signal from the checker unit 18. In this situation, it can happen that a portion of the continuous rod 5 remains lodged between the cut-off device 19 and the cutter device 16, occupying the final part of the feed path X.

In order to remove this portion of material, the machine 2 can be equipped with suitable ejection means 20 acting directly on the selfsame portion.

Still in FIG. 1, the separation device 1 is associated functionally with the cut-off device 19 in such a way as to engage the diverted continuous rod 5 and divide it into a plurality of lengths 21 of forming material which are then collected in a reclaiming station 22.

More exactly, the separation device 1 comprises a gripping unit 23 of which the function is to act on the diverted continuous rod 5 by applying forces oriented substantially parallel to the longitudinal dimension of the rod and from opposing directions, so as to generate a tensile stress that will cause a break by tearing.

Figure 2:
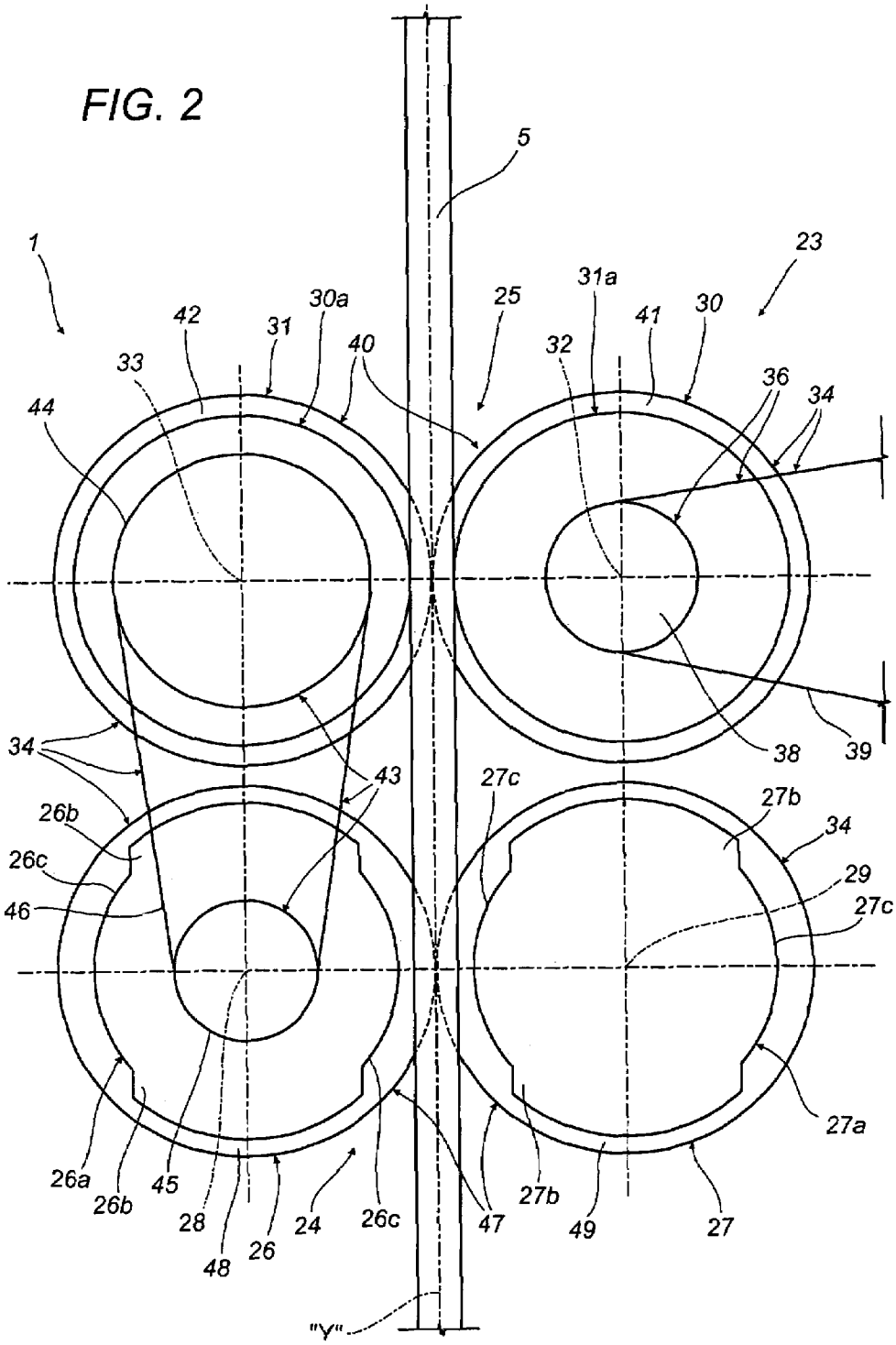
FIG. 2 is an enlarged view of the separation device illustrated in FIG. 1, shown in readiness to interact with the advancing continuous rod.
Figure 3:
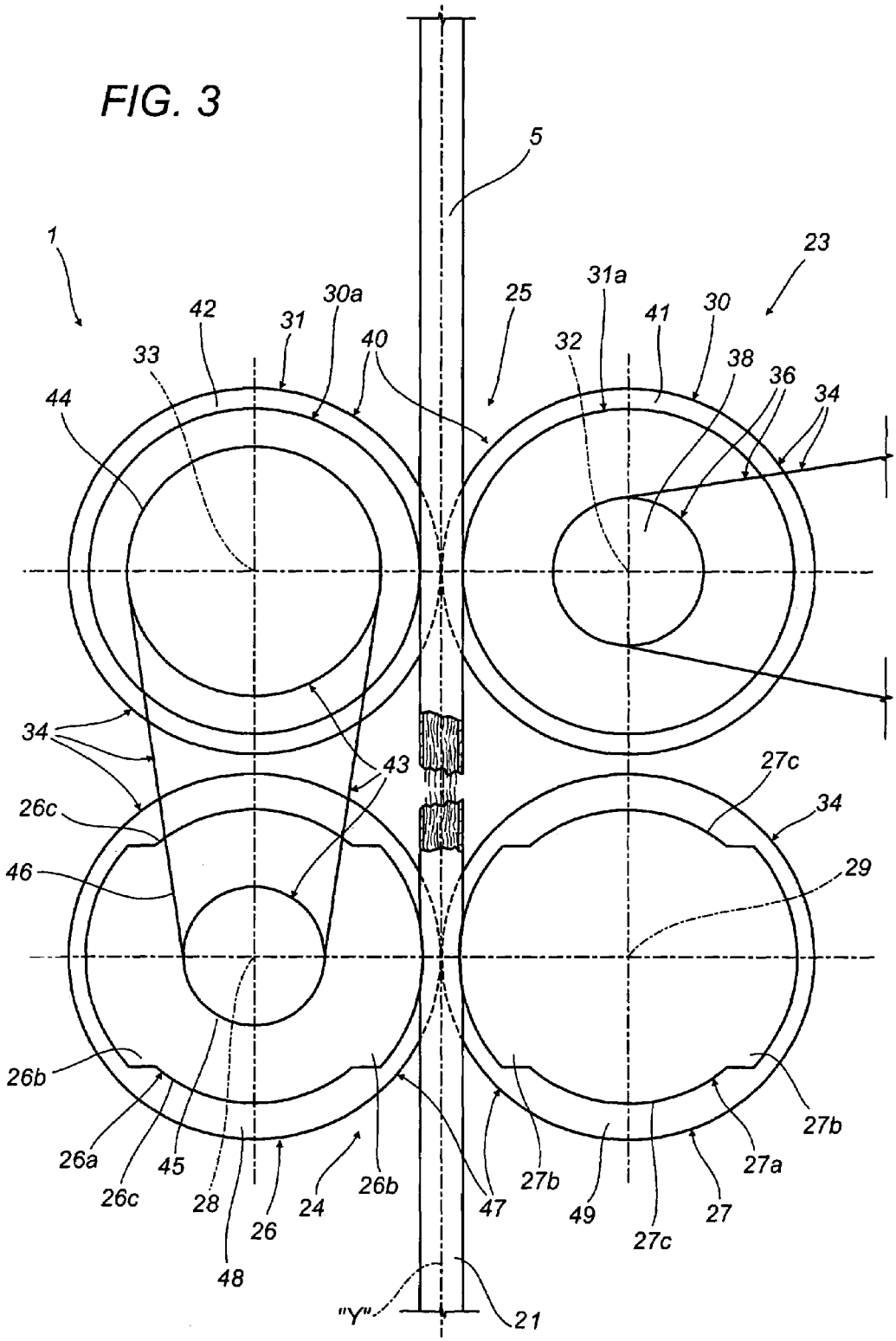
FIG. 3 is an enlarged view of the separation device illustrated in FIG. 1 and FIG. 2, shown interacting with the advancing forming material, which is viewed partly in section.

As illustrated in the accompanying drawings, and more particularly in FIGS. 2 and 3, the gripping unit 23 of the separation device 1 comprises a tensioning unit 24 acting on the continuous rod 5 in such a way as to apply a predetermined pulling force that tends to distance the selfsame rod from the cut-off device 19. The gripping unit 23 also includes a braking unit 25 associated functionally with the tensioning unit 24, located between this same unit and the cut-off device 19. The braking unit 25 likewise acts directly on the diverted continuous rod 5, operating in conjunction with the tensioning unit 24 so as to induce a tear in the rod 5 at a point between the two units 24 and 25.

The tensioning unit 24 comprises at least one pair of tension rollers 26 and 27 positioned to interact tangentially with opposite sides of the continuous rod 5. Each tension roller 26 and 27 engages the diverted continuous rod 5 by way of a respective contact surface 26*a* and 27*a* presenting a substantially irregular profile, so that the rod 5 will be subjected to the pulling action of the two rollers 26 and 27 at predetermined intervals. More particularly, the contact surface 26*a* and 27*a* of each tension roller 26 and 27 presents at least one pinch portion 26*b* and 27*b* of substantially curved profile proportioned so as to engage the advancing continuous rod 5 directly, and at least one release portion 26*c* and 27*c* extending circumferentially from the pinch portion 26*b* and 27*b* to describe a circular arc of given length, of which the profile is lower than that of the pinch portion and offers no constraint to the advancing rod 5.

In the example of the accompanying drawings, each tension roller 26 and 27 presents a corresponding contact surface 26*a* and 27*a* with two diametrically opposed pinch portions 26*b* and 27*b*. Each of the two pinch portions 26*b* and 27*b* is located between two release portions 26*c* and 27*c* which in turn occupy diametrically opposed positions on the respective roller 26 and 27.

It would also be possible, should requirements so dictate, for the tension rollers 26 and 27 to have more than two pinch portions 26*b* and 27*b* and two release portions 26*c* and 27*c* as in the example of the drawings, without the object of the present invention being altered and/or limited in any way.

In addition, the tension rollers 26 and 27 are symmetrically identical relative to a longitudinal axis Y of the diverted continuous rod 5, so that the circular arcs described on either side of the axis Y by the pinch portions 26*b* and 27*b* and/or the release portions 26*c* and 27*c* will be, in practice, mirror images of one another.

The two tension rollers 26 and 27 can be driven in rotation about their relative axes 28 and 29, and are interconnected in such a way as to turn at the same peripheral speed. In this way, the matched pinch portions 26*b* and 27*b* will engage the diverted continuous rod 5 simultaneously, whilst the matched release portions 26*c* and 27*c*, in combination with the linear velocity of the rod, will determine the duration of the period for which the rod is allowed to advance freely before being engaged by further pinch portions 26*b* and 27*b*.

Similarly, the aforementioned braking unit 25 comprises at least one pair of brake rollers 30 and 31 positioned so as to interact tangentially with opposite sides of the continuous rod 5 by way of respective contact surfaces 30*a* and 31*a* presenting a substantially regular profile. The two brake rollers 30 and 31 are interconnected in operation and rotatable about respective axes 32 and 33 at angular velocities such that their peripheral speed will be essentially the same as the linear velocity of the advancing continuous rod 5. In short, the brake rollers 30 and 31 do no more than accompany the movement of the diverted continuous rod 5 as it advances toward the tension rollers 26 and 27.

As illustrated in the accompanying drawings, the axes of rotation 28, 29, 32 and 33 of the tension rollers 26 and 27 and the brake rollers 30 and 31 lie substantially parallel. More precisely, the axes 28 and 29 of the tension rollers 26 and 27 occupy a common plane transverse and preferably perpendicular to the longitudinal axis Y of the diverted continuous rod 5, whilst the axes 32 and 33 of the brake rollers 30 and 31 likewise occupy a common plane transverse to the longitudinal axis Y of the diverted continuous rod 5 and substantially parallel to the plane occupied by the axes 28 and 29 of the tension rollers 26 and 27.

The separation device 1 is also equipped with transmission means 34 that can be connected to a drive component 35 installed in the machine 2, for the purpose of setting the tension rollers 26 and 27 and the brake rollers 30 and 31 in rotation.

As illustrated in the drawings, the transmission means 34 comprise a first transmission component 36 interposed between one of the brake rollers 30 and 31 and the drive component 35 of the machine 2. The first transmission component 36 comprises a first wheel 37 associated with the drive component 35 of the machine 2, a second wheel 38 associated with one of the two rollers of the braking unit 25, or rather a driving brake roller 30, and at least one flexible transmission element 39 consisting in a belt, a chain and/or the like, looped around the first and second wheels 37 and 38.

The transmission means 34 also comprise a second transmission component 40 associated functionally with the brake rollers 30 and 31 and serving to transmit rotation from the driving brake roller 30 to the other brake roller 31, which consequently is driven at the same peripheral speed as the driving roller 30.

More particularly, the aforementioned second transmission component 40 is composed of a first and a second rotary transmission element 41 and 42 associated respectively with the driving and driven brake rollers 30 and 31, projecting radially beyond the circumference of these rollers although not interfering in any way with the movement of the advancing diverted continuous rod 5. Preferably, the rotary transmission elements 41 and 42 of the second transmission component 40 will consist in respective gears.

The transmission means 34 also comprise a third transmission component 43 interposed between the braking unit 25 and the tensioning unit 24 and serving thus to transmit rotation to at least one tension roller 26 or 27 of this same Unit. More exactly, the third transmission component 43 is interposed functionally between the driven brake roller 31 and a driving tension roller 26 of which the axis of rotation 28 lies in the same plane as that occupied by the axis 33 of the driven brake roller 31, the plane in question lying parallel to the longitudinal axis Y of the diverted continuous rod 5.

As illustrated in the drawings and in like manner to the first transmission component 34, the third transmission component 43 comprises a first wheel 44 associated with the driven brake roller 31, a second wheel 45 associated with the driving tension roller 26, and at least one flexible transmission element 46 looped around the first wheel 44 and the second wheel 45. It will be seen in the drawings that the second wheel 45 of the third transmission component 43 is smaller in diameter than the first wheel 44 in such a way that the peripheral speed of the driving tension roller 26 will be greater than that of the driven brake roller 31.

A further fourth transmission component 47 of the transmission means 34, associated functionally with the tension rollers 26 and 27, serves to transmit rotation from the driving tension roller 26 to the other tension roller 27, which is driven at the same peripheral speed as the driving roller.

Like the second transmission component 40, this fourth transmission component 47 takes the form of a first and a second rotary transmission element 48 and 49 associated respectively with the driving and driven tension rollers 26 and 27 and projecting radially beyond the circumference of these rollers although not interfering with the movement of the advancing diverted continuous rod 5. Preferably, the rotary transmission elements 48 and 49 of this fourth transmission component 47 will consist in respective gears combining one with another to ensure that the tension rollers 26 and 27 turn at the same peripheral speed.

The separation device 1, described prevalently in structural terms thus far, is designed to operate in the following manner.

Whenever the machine 2 is started and/or stopped, or in response to a control signal from the checker unit 18, the continuous rod 5 advancing along the feed path X is diverted by the cut-off device 19 toward the separation device 1.

On entering the separation device 1, the diverted continuous rod 5 is guided forward by the brake rollers 30 and 31, rotating at a peripheral speed equal to the linear velocity of the advancing rod. In effect, when the continuous rod 5 is diverted from its feed path X, the drive component 35 of the machine 2 is activated in such a way as to set in motion the first wheel 37 of the first transmission component 36 connected to the separation device 1. In rotation, the first wheel 37 drives the flexible transmission element 39, thereby causing the second wheel 38 of the first transmission component 36 to rotate, and with it the driving brake roller 30. As the driving brake roller 30 is also linked to the driven brake roller 31 by meshing gears, the driven roller 31 likewise will be set in motion by the driving roller 30 at the same peripheral speed.

Rotation is transmitted in turn from the driven brake roller 31 to the driving tension roller 26, by way of the third transmission component 43. More exactly, given that the first wheel 44 of the third transmission component 43 rotates as one with the driven brake roller 31, the corresponding flexible transmission element 46 is also set in motion. As a result, this same flexible transmission element 46 in turn will cause the second wheel 45 of the third transmission component 43 to rotate, and with it the associated driving tension roller 26, in this instance at a peripheral speed greater than that of the brake rollers 30 and 31.

Lastly, the driving tension roller 26 is linked by way of the fourth transmission component 47 to the driven tension roller 27, with both rotating at the same peripheral speed.

Passing through the tension rollers 26 and 27, the diverted continuous rod 5 is engaged cyclically by the pinch portions 26*b* and 27*b* of these same rollers. Each time two pinch portions 26*b* and 27*b* enter into contact with the continuous rod 5, it is pulled sharply away from the cut-off device 19. The action of the two tension rollers 26 and 27 is also opposed by that of the brake rollers 30 and 31, so that the portion of the continuous rod 5 extending between the two pairs of rollers will be subjected to a tensile stress causing it ultimately to break (FIG. 3). To advantage, this has the effect of separating a length 21 of forming material in which the tobacco fibers remain substantially whole and can be used again.

The detached lengths 21 of material emerging from the separation device 1 are then collected by the reclaiming station 22.

The problems associated with the prior art are overcome by the present invention, and with notable advantages.

Firstly, the separation device according to the present invention is able to divide the reclaimable continuous rod 5 into a plurality of lengths 21 containing tobacco fibers that remain intact and are thus reusable. Indeed, because the separation of the continuous rod 5 into discrete lengths 21 is brought about without any cutting action involved, the structural attributes of the tobacco fibers can be preserved.

It will be appreciated also, that with no need to reject forming material, the costs of manufacturing and/or marketing and selling the tobacco products can be significantly reduced.

What is claimed is:

1. A device for separating at least one continuous rod of forming material for the manufacture of tobacco products, for use with a machine for making tobacco products affording a feed path along which the continuous rod is caused to advance, and equipped with at least one cut-off device by which the continuous rod is severed and diverted from the feed path, wherein the separation device comprises a gripping unit for engaging the diverted continuous rod of forming material and acting on the diverted continuous rod by applying forces oriented substantially parallel to a longitudinal dimension of the rod and from opposing directions, so as to generate a tensile stress in the diverted rod that causes it to break by tearing apart and thus divide into a plurality of discrete lengths, wherein the gripping unit comprises a tensioning unit acting on the diverted continuous rod at a point downstream of the cut-off device, by which a predetermined pulling force is applied to the selfsame rod and wherein the tensioning unit comprises at least one pair of tension rollers, interacting tangentially with opposite sides of the diverted continuous rod and each tension roller engaging in direct contact with the diverted continuous rod by way of a respective contact surface that presents an irregular profile, in such a manner as to engage the diverted continuous rod intermittently at predetermined intervals.

2. A device as in claim 1, wherein the gripping unit comprises:

a braking unit, acting on the diverted continuous rod at a point between the cut-off device and the tensioning unit and in such a way that the tensioning unit and the braking unit combine one with another to tear apart a portion of the diverted continuous rod extending between the tensioning and braking units.

3. A device as in claim 2, wherein the tension rollers interacting tangentially with opposite sides of the diverted continuous rod rotate at the same peripheral speed.

4. A device as in claim 3, wherein the contact surface presented by each tension roller comprises:

at least one pinch portion presenting a substantially curved profile, such as will engage directly with the diverted continuous rod;

at least one release portion extending circumferentially from the pinch portion through a circular arc of predetermined length, of which the profile is lower than that of the pinch portion so as to afford an unconstrained passage to the diverted continuous rod.

5. A device as in claim 4, wherein the tension rollers are disposed symmetrically relative to a longitudinal axis of the diverted continuous rod, with the relative pinch portions extending through substantially identical circular arcs and the release portions extending similarly through identical circular arcs, in such a way that the pinch portions of the rollers engage in contact simultaneously with the diverted continuous rod, whilst the release portions combine simultaneously to determine the duration of the period for which the diverted continuous rod is able to advance unconstrained.

6. A device as in claim 3, wherein the braking unit comprises at least one pair of brake rollers offered tangentially to opposite sides of the diverted continuous rod and rotating both at the same peripheral speed, slower than the peripheral speed of the tension rollers.

7. A device as in claim 6, wherein the tension rollers and the brake rollers are set in rotation about substantially parallel axes.

8. A device as in claim 7, wherein:

axes of rotation of the tension rollers occupy a common plane disposed transversely to a longitudinal axis of the diverted continuous rod;

axes of rotation of the brake rollers occupy a common plane disposed transversely to a longitudinal axis of the diverted continuous rod.

9. A device as in claim 6, further comprising transmission means such as can be coupled to a drive component of the machine for making tobacco products in order to set the brake rollers and the tension rollers in rotation.

10. A device as in claim 9, wherein the transmission means comprise a first transmission component interposed functionally between one brake roller of the braking unit and the drive component of the machine for making tobacco products.

11. A device as in claim 10, wherein the first transmission component comprises:

a first wheel associated with the drive component of the machine for making tobacco products;

a second wheel associated with a driving brake roller of the braking unit;

at least one flexible transmission element looped around the first and second wheels.

12. A device as in claim 11, wherein the transmission means comprise a second transmission component associated functionally with the brake rollers and serving to transmit rotary motion from the driving brake roller to the other brake roller of the braking unit, so that this same roller is driven in rotation by the driving brake roller.

13. A device as in claim 12, wherein the second transmission component comprises:

a first rotary transmission element associated with the driving brake roller and projecting radially beyond the circumference of the selfsame roller without affecting the movement of the advancing diverted continuous rod;

a second rotary transmission element associated with the driven brake roller and projecting radially beyond the circumference of the self same roller, operating in conjunction with the first rotary transmission element and in such a way that the driven brake roller is set in rotation at the same peripheral speed as the driving brake roller.

14. A device as in claim 12, wherein transmission means further comprise a third transmission component interposed functionally between the braking unit and the tensioning unit in such a way as to transmit rotary motion to at least one tension roller of the tensioning unit.

15. A device as in claim 14, wherein the third transmission component is interposed functionally between the driven brake roller and a driving tension roller of the tensioning unit of which the axis of rotation lies in the same plane as that occupied by the axis of the driven brake roller.

16. A device as in claim 15, wherein the third transmission component comprises:

a first wheel associated with the driven brake roller;

a second wheel associated with the driving tension roller and of diameter smaller than the diameter of the first wheel, in such a way that the driving tension roller can be set in rotation at a peripheral speed higher than the peripheral speed of the driven brake roller;

at least one flexible transmission element looped around the first and second wheels.

17. A device as in claim 15, wherein transmission means further comprise a fourth transmission component associated functionally with the tension rollers and serving to transmit rotary motion from the driving tension roller to the other tension roller of the tensioning unit, so that this same roller is driven in rotation by the driving tension roller.

18. A device as in claim 17, wherein the fourth transmission component comprises:

a first rotary transmission element associated with the driving tension roller and projecting radially beyond the circumference of the self same roller without affecting the movement of the advancing diverted continuous rod;

a second rotary transmission element associated with the driven tension roller and projecting radially beyond the circumference of the selfsame roller, operating in conjunction with the first rotary transmission element and in such a way that the driven tension roller is set in rotation at the same peripheral speed as the driving tension roller.

19. A device as in claim 1, wherein the separating action of the device is generated without the use of cutting elements.

20. A machine for making tobacco products, establishing a feed path along which to advance a continuous rod of forming material used in fashioning the products, comprising:

a forming unit by which the continuous rod of forming material is generated;

a cutter device operating downstream of the forming unit generating the continuous rod, by which the selfsame rod is divided into discrete portions each ultimately constituting a single tobacco product;

a cut-off device interposed functionally between the forming unit and the cutter device, capable of movement between a position of disengagement, in which the continuous rod of forming material is free to advance as normal along the feed path, and a position of interference in which the continuous rod is cut through and diverted from the feed path by the device; and a device for separating the diverted continuous rod, wherein the separation device comprises a gripping unit for engaging the diverted continuous rod of forming material and acting on the diverted continuous rod by applying forces oriented substantially parallel to a longitudinal dimension of the rod and from opposing directions, so as to generate a tensile stress in the diverted rod that causes it to break by tearing apart and thus divide into a plurality of discrete lengths, wherein the gripping unit comprises a tensioning unit acting on the diverted continuous rod at a point downstream of the cut-off device, by which a predetermined pulling force is applied to the selfsame rod and wherein the tensioning unit comprises at least one pair of tension rollers, interacting tangentially with opposite sides of the diverted continuous rod and each tension roller engaging in direct contact with the diverted continuous rod by way of a respective contact surface that presents an irregular profile, in such a manner as to engage the diverted continuous rod intermittently at predetermined intervals.

21. A method of separating at least one continuous rod of forming material for making tobacco products into a plurality of reclaimable lengths, wherein the separation of the continuous rod of forming material includes the step of applying at least two forces oriented parallel to a longitudinal axis of the continuous rod and from opposing directions; and applying one of the opposing two forces with a pair of tension rollers interacting tangentially along opposite sides of the continuous rod wherein each tension roller engages in direct contact with the continuous rod by way of a respective contact surface that presents an irregular profile, in such a manner as to engage the continuous rod intermittently at predetermined intervals.

22. A method as in claim 21, wherein the at least two forces oriented parallel to the longitudinal axis of the continuous rod and generated from opposing directions are applied at a strength such as to place the continuous rod under a tensile stress that will cause it to break by tearing apart.

23. A method as in claim 21, wherein the step of separating the continuous rod is effected without cutting operations.

* * * * *